US010819015B2

(12) United States Patent
Luo

(10) Patent No.: US 10,819,015 B2
(45) Date of Patent: Oct. 27, 2020

(54) ANTENNA SYSTEM AND MOBILE TERMINAL

(71) Applicant: AAC Technologies Pte. Ltd., Singapore (SG)

(72) Inventor: Jingqiang Luo, Shenzhen (CN)

(73) Assignee: AAC Technologies Pte. Ltd., Singapore (SG)

( * ) Notice: Subject to any disclaimer, the term of this patent is extended or adjusted under 35 U.S.C. 154(b) by 0 days.

(21) Appl. No.: 16/524,219

(22) Filed: Jul. 29, 2019

(65) Prior Publication Data

US 2020/0052381 A1 Feb. 13, 2020

(51) Int. Cl.
*H01Q 1/24* (2006.01)
*H01Q 7/00* (2006.01)
*H01Q 21/00* (2006.01)

(52) U.S. Cl.
CPC ..... *H01Q 1/243* (2013.01); *H01Q 7/005* (2013.01); *H01Q 21/0006* (2013.01)

(58) Field of Classification Search
CPC .. H01Q 1/12; H01Q 1/22; H01Q 1/24; H01Q 1/241; H01Q 1/242; H01Q 1/243; H01Q 1/36; H01Q 1/50; H01Q 7/00; H01Q 7/005; H01Q 21/0006; H01Q 21/30
See application file for complete search history.

(56) References Cited

U.S. PATENT DOCUMENTS 10,038,245 B2 * 7/2018 Choi ..... H01Q 9/42
10,290,925 B2 * 5/2019 Huang ..... H01Q 9/42
10,707,579 B2 * 7/2020 Krogerus ..... H01Q 5/364
2012/0105287 A1 * 5/2012 Jung ..... H01Q 5/15 343/702
2012/0218723 A1 * 8/2012 Kwak ..... H01Q 1/243 361/748
2014/0078008 A1 * 3/2014 Kang ..... H01Q 7/00 343/702
2015/0207210 A1 * 7/2015 Martiskainen ..... H01Q 1/243 343/702
2016/0064820 A1 * 3/2016 Kim ..... H01Q 9/0421 343/767
2016/0064832 A1 * 3/2016 Shin ..... H01Q 1/243 343/702
2016/0164168 A1 * 6/2016 Choi ..... H01Q 1/243 343/702
2016/0164169 A1 * 6/2016 Krogerus ..... H01Q 13/10 343/702
2016/0182112 A1 * 6/2016 Kim ..... H01Q 1/42 455/572
2016/0226132 A1 * 8/2016 Kim ..... H01Q 1/243
2016/0294042 A1 * 10/2016 Wang ..... H01Q 5/335
2017/0033812 A1 * 2/2017 Son ..... H04B 1/0483
(Continued)

*Primary Examiner* — Jason Crawford
(74) *Attorney, Agent, or Firm* — W&G Law Group LLP

(57) ABSTRACT

The present invention provides an antenna system applied to a mobile terminal. The mobile terminal includes a metal bezel, a plastic back shell and a main board. The antenna system includes a metal trace. The metal trace includes a feed section, a radiating section, a first loop unit and a second loop unit. The main board is provided with one feed point connected to both the feed section and the metal bezel, two ground points respectively connected to an end, away from the feed section, of the first loop unit and an end, away from the feed section, of the second loop unit, and a tuning switch connected to the metal bezel.

14 Claims, 5 Drawing Sheets

(56) References Cited

U.S. PATENT DOCUMENTS

| | | | | |
|---|---|---|---|---|
| 2017/0047639 | A1* | 2/2017 | Lee | H01Q 1/243 |
| 2017/0048363 | A1* | 2/2017 | Lee | H04B 1/3833 |
| 2017/0117615 | A1* | 4/2017 | Choon | H01Q 5/328 |
| 2017/0170562 | A1* | 6/2017 | Lee | H01Q 7/00 |
| 2018/0375195 | A1* | 12/2018 | Liu | H01Q 1/48 |
| 2019/0363426 | A1* | 11/2019 | Su | H01Q 1/243 |
| 2020/0044347 | A1* | 2/2020 | Hang | H01Q 5/328 |
| 2020/0052380 | A1* | 2/2020 | Shi | H01Q 5/342 |
| 2020/0161769 | A1* | 5/2020 | Hu | H01Q 9/0421 |

* cited by examiner

ANTENNA SYSTEM AND MOBILE TERMINAL

TECHNICAL FIELD

The present disclosure relates to the field of antenna technology, especially an antenna system and a mobile terminal.

BACKGROUND

With continuous development of communication technology, requirements for a mobile terminal become more and more diverse, and the requirement for an antenna in a mobile terminal becomes higher and higher.

At present, a screen-to-body ratio of a mobile terminal like a mobile phone is larger and larger, rendering that a clearance region at the internal of the mobile terminal is getting smaller, which leads to greater loss of a feeder line of an antenna, and so radiating efficiency of the antenna cannot meet what is required. Besides, an antenna solution of a conventional metal ring structure may also lead to the problem that there is a color difference at a gap.

Therefore, it is necessary to provide a new antenna system to solve the above-described problem.

BRIEF DESCRIPTION OF THE DRAWINGS

In order to describe technical solutions in the embodiments of the present disclosure more clearly, accompany drawings used to describe the embodiments are briefly illustrated below. It is evident that the drawings in the following description are only some embodiments of the present disclosure. For those skilled in the art, in a case where no inventive effort is made, other drawings may be obtained according to these drawings.

DETAILED DESCRIPTION

The technical solutions in embodiments of the present disclosure will be clearly and completely described with reference to the accompany drawings of the present disclosure. It is evident that the embodiments described are only some rather than all embodiments of the present disclosure. Based on the embodiments of the present disclosure, all other embodiments obtained by skilled persons in the art without making any inventive effort fall into the disclosure of protection by the present disclosure.

Figure 1:
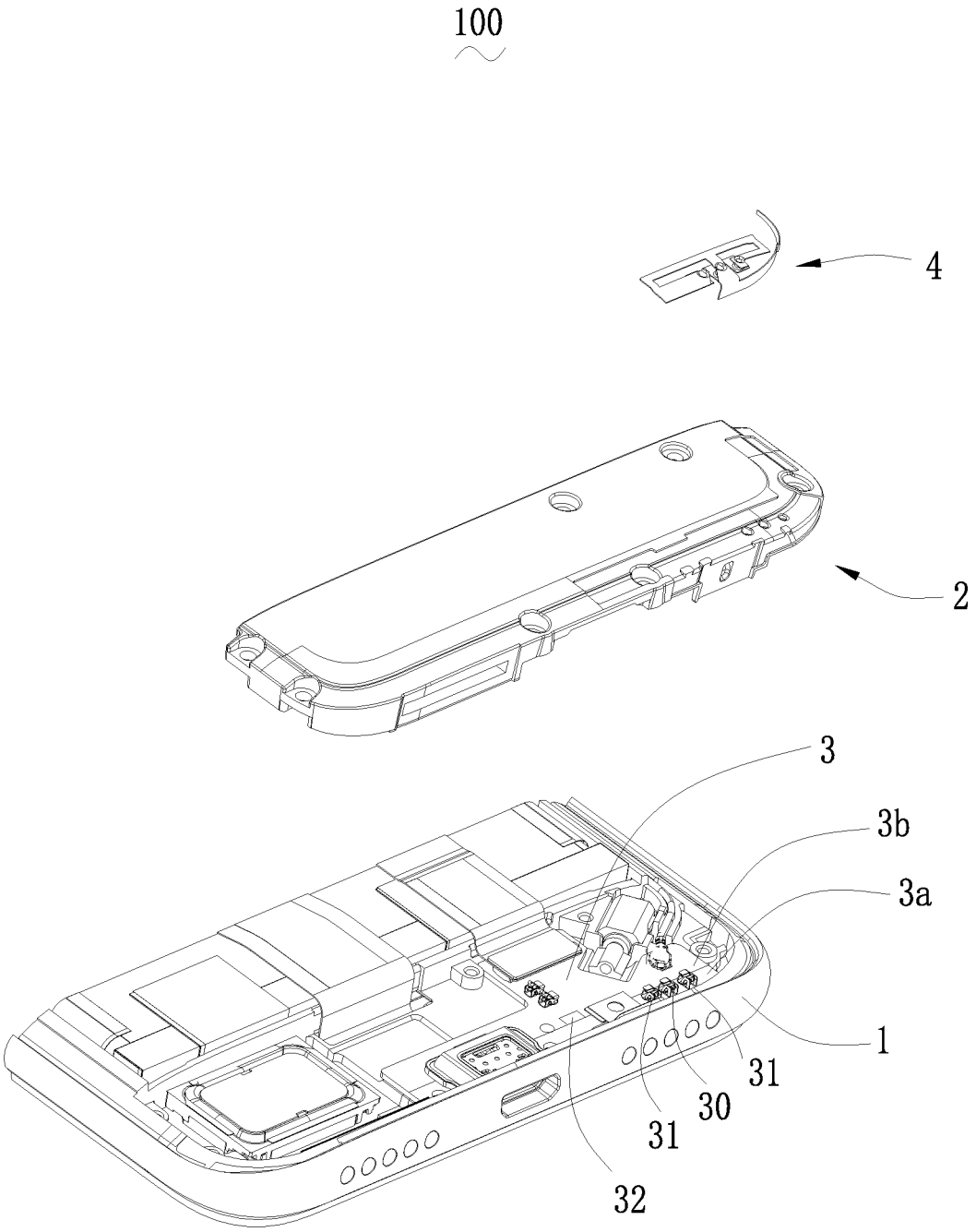
FIG. 1 is an exploded perspective view of a mobile terminal in the present disclosure.
Figure 2:
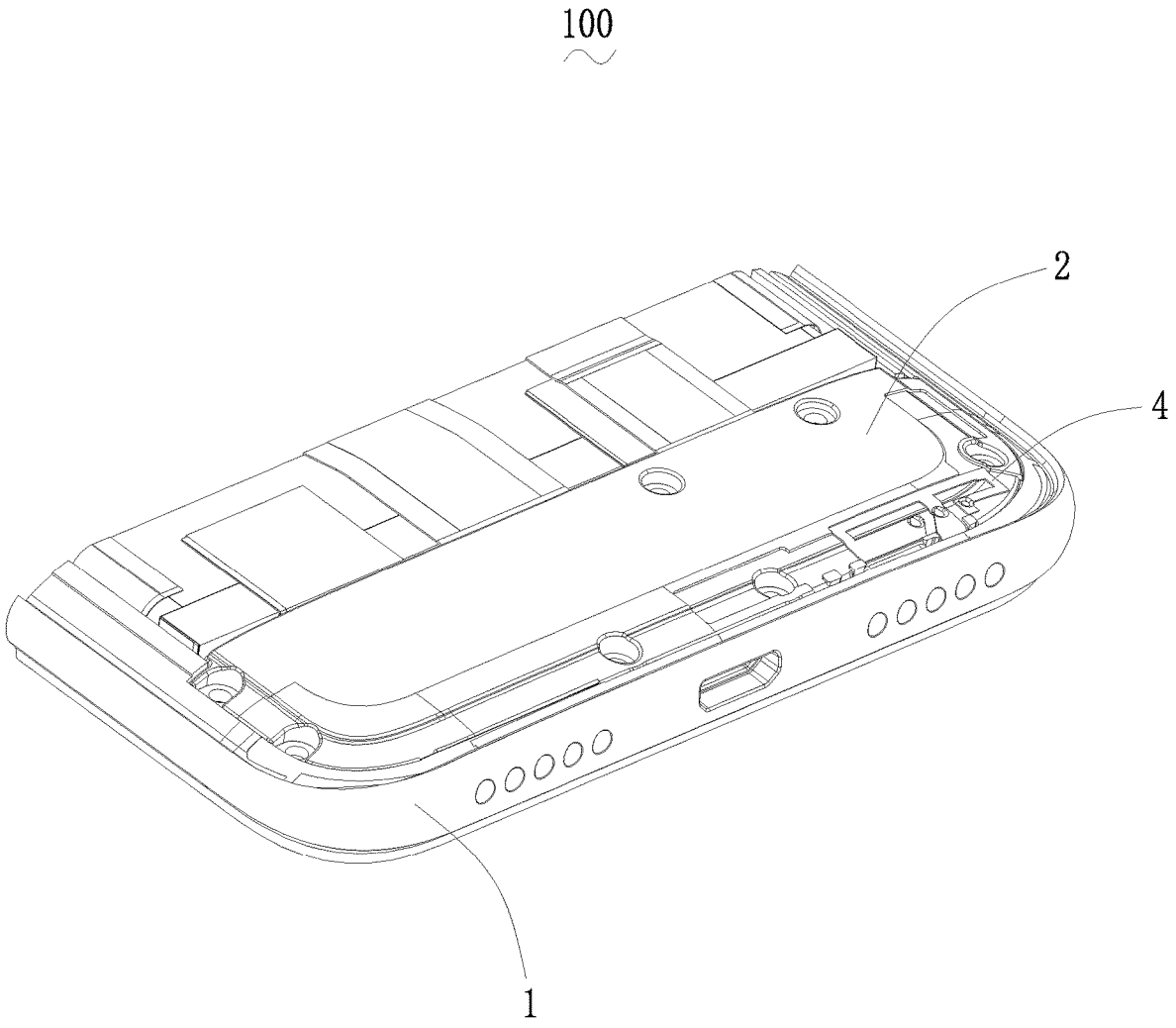
FIG. 2 is an perspective structural view of the mobile terminal in the present disclosure.

With reference to FIG. 1 and FIG. 2, an embodiment of the present disclosure provides an antenna system applied to a mobile terminal 100. The mobile terminal 100 includes a metal bezel 1, a plastic back shell 2 adjacent to the metal bezel and a main board 3 accommodated in the plastic back shell 2. One end of the main board 3 is provided with a clearance region 3*a*. In specific embodiments of the present disclosure, the width of the clearance region 3*a* is 1.87 mm.

The width of the clearance region 3*a* indicates a distance between a system ground 3*b* of the main board 3 and the metal bezel 1.

The antenna system includes a metal trace 4 that is disposed on the plastic back shell 2 through an LDS processing and that is disposed as corresponding to the clearance region. Operation frequency bands of the antenna system are 700-960 MHzs and 1710-2690 MHzs.

In a preferable embodiment of the present disclosure, the metal trace 4 is disposed at the plastic back shell 2 through an LDS processing and an in-mode decoration metal processing. Specifically, the metal trace 4 is disposed at the outside surface of the plastic back shell 2, thereby effectively preventing the problem that a color difference exists at a gap in a conventional metal ring. The main board 3 is provided with a tuning switch 32 connected to the metal bezel. Naturally, the main board 3 is further installed with other electronic elements such as a speaker, a microphone, a USB connector, a motor and so on.

Figure 3:
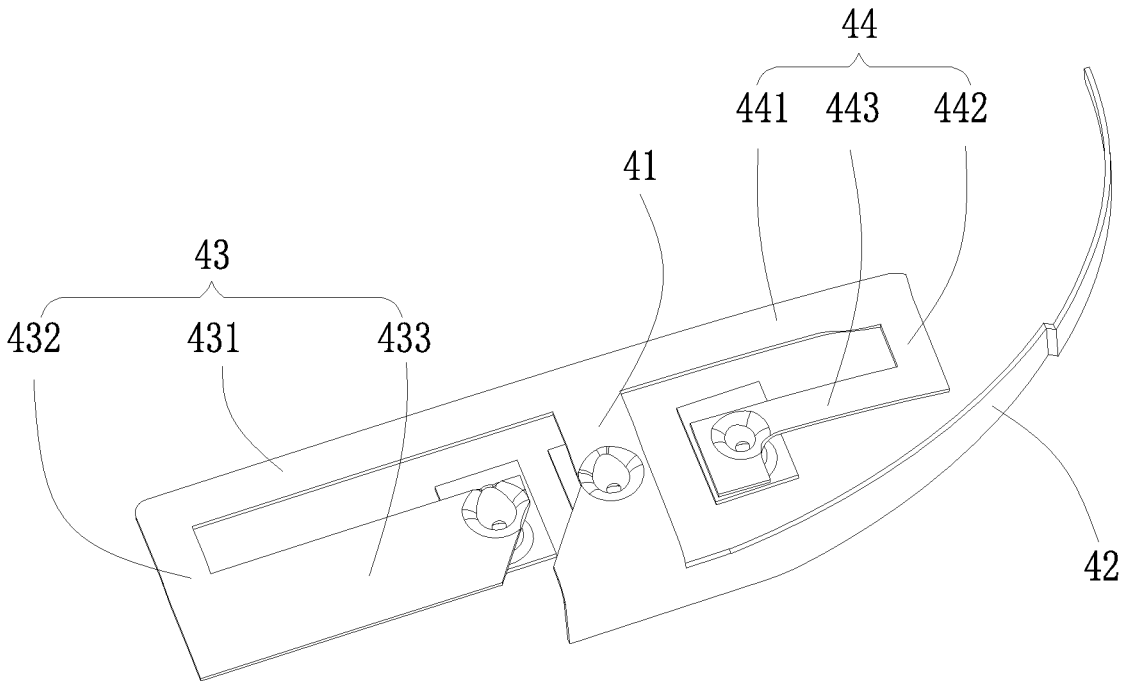
FIG. 3 is a schematic view of a metal trace in the present disclosure.

With further reference to FIGS. 1-3, the metal trace 4 includes a feed section 41, a radiating section 42 in bent extension from one end, closer to the metal bezel 1, of the feed section 41, and a first loop unit 43 and a second loop unit 44 that are in bent extension from the other end of the feed section 41 to both sides of the feed section 41 respectively. The metal trace 4 is disposed as opposite to and separated from the metal bezel 1. The length of the radiating section 42 may adjust band width of a high frequency band of the metal trace 4; the first loop unit 43 and the second loop unit 44 are configured to adjust the band depth and band width of the metal trace 4, and may effectively reduce loss of an antenna signal on a feeder line, while improving radiating efficiency of the metal trace 4.

The main board 3 is provided with one feed point 30 connected to both the feed section 41 and the metal bezel 1, two ground points 31 respectively connected to an end, away from the feed section 41, of the first loop unit 43 and an end, away from the feed section 41, of the second loop unit 44, and a tuning switch 32 connected to the metal bezel 1. Specifically, the feed section 41 abuts the feed point 30 elastically through an elastic pin, thereby realizing electrical connection with an antenna feed circuit. Similarly, the first loop unit 43 and the second loop unit 44 elastically abut two ground points 31 through an electric pin respectively.

The first loop unit 43 includes a first part 431 extending from the feed section 41 to a direction away from the second loop unit 44, a second part 432 extending from an end, away from the feed section 41, of the first part 431 to a direction towards the metal bezel 1, and a third part 433 extending from an end, away from the first part 431, of the second part 432 to a direction approaching the second loop unit 44. An end, away from the second part 432, of the third part 433 is connected to the ground point 31.

The second loop unit 44 includes a fourth part 441 extending from the feed section 41 to a direction away from the first loop unit 43, a fifth part 442 vertically extending from an end, away from the feed section 41, of the fourth part 441 to a direction towards the metal bezel 1, and a sixth part 443 extending from an end, away from the fourth part 441, of the fifth part 442 to a direction approaching the first loop unit 43. An end, away from the fifth part 442, of the sixth part 443 is connected to the ground point 31.

Figure 4:
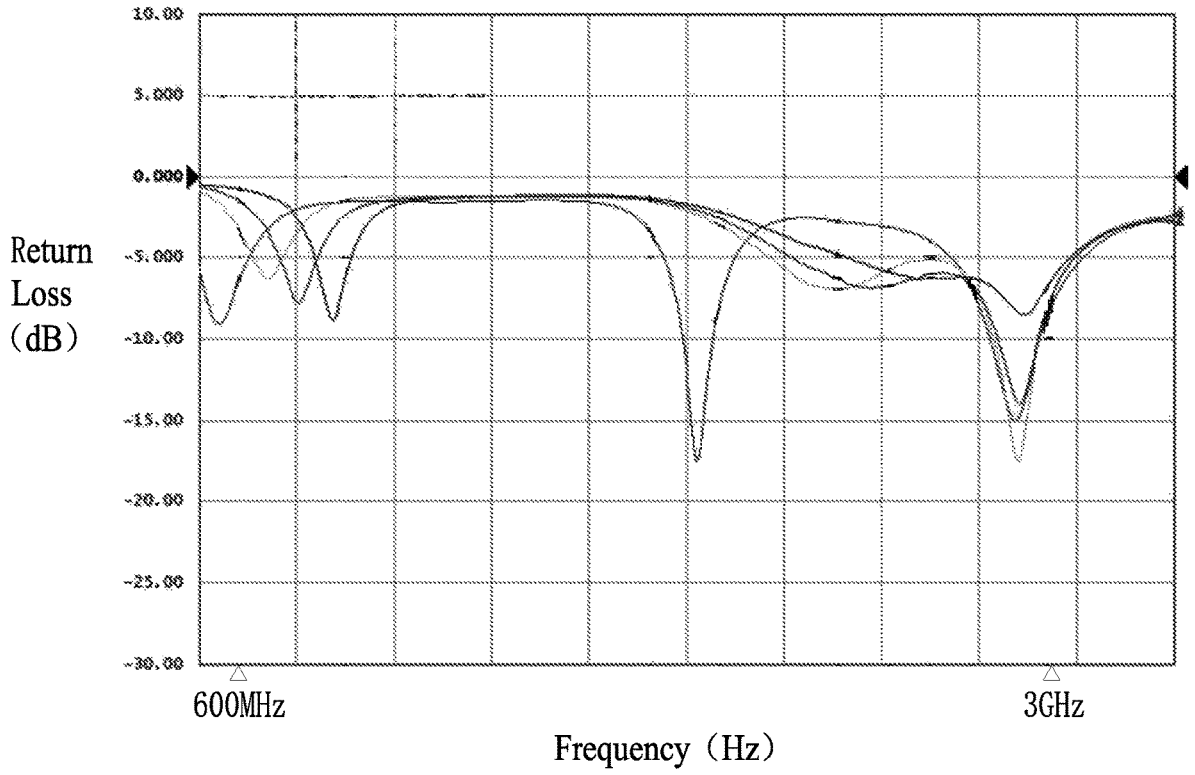
FIG. 4 is a diagram showing return loss of an antenna system in the present disclosure.
Figure 5:
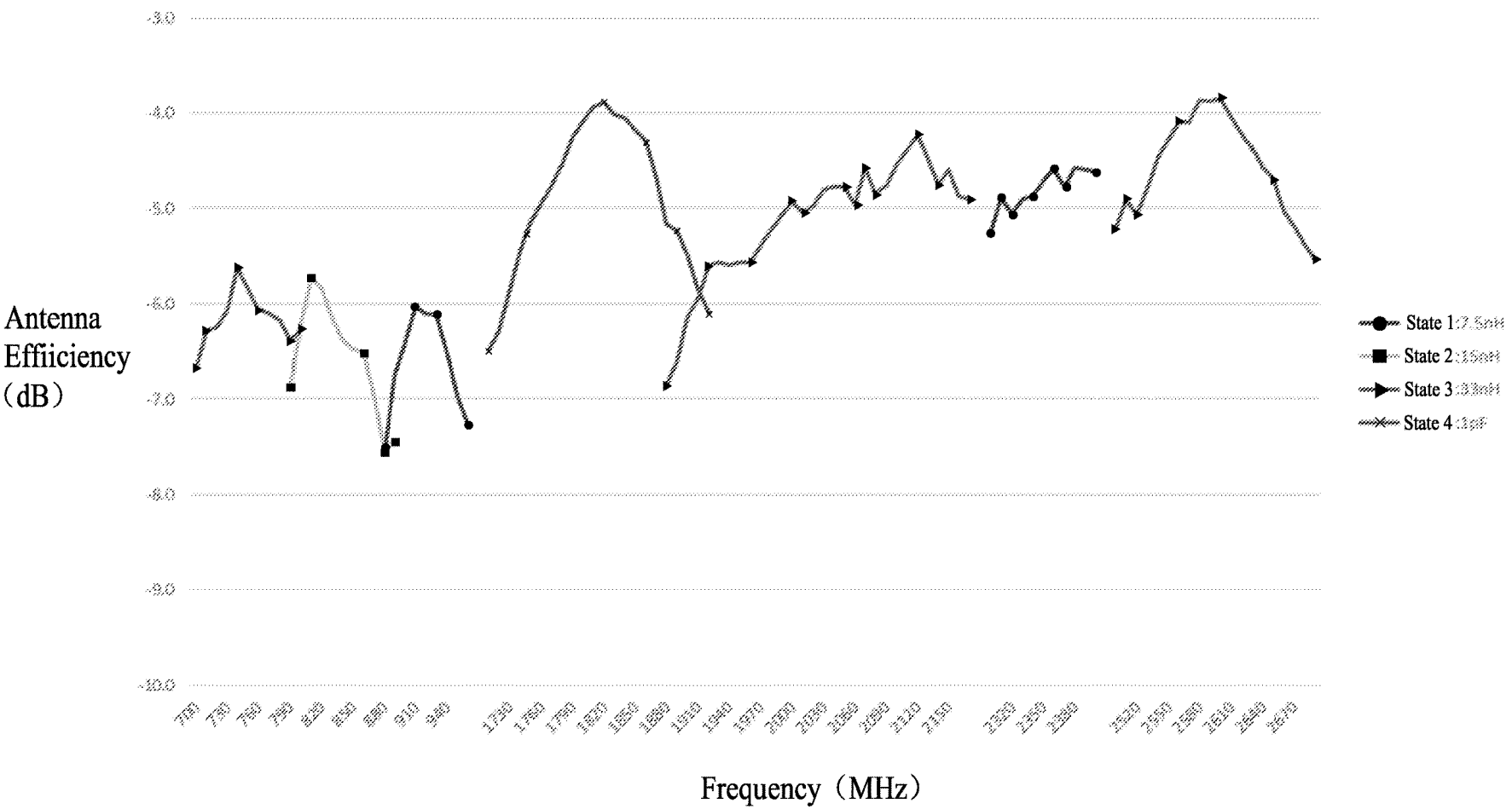
FIG. 5 is a diagram showing antenna efficiency of an antenna system in the present disclosure.

The tuning switch is configured to adjust frequency drift of the antenna. Specifically, as shown in FIG. 4, the antenna system has four operation states upon switching the tuning switch. As shown in FIG. 5, when the operation frequency bands of the loop antenna 4 are 700-960 MHzs and 1710-2690 MHzs, antenna efficiency meets a requirement on antenna performance.

The present disclosure further provides a mobile terminal including a notch screen, i.e., a screen obtained by irregularly-cut process, and an antenna system as described above. An antenna clearance region of a mobile terminal to which the notch screen is applied is more advantageous than a conventional flexible printed circuit (FPC) board and LDS solution. In an extreme case (for example, a clearance region of 1.8 mm), performance of an antenna meets what is needed.

Compared with a related art, the antenna system provided in the present disclosure has the following advantages: by disposing two loop units, band depth and band width of a metal trace can be adjusted, and loss of an antenna signal on a feeder line can be reduced while radiating efficiency of the metal trace can be improved; by disposing a tuning switch, frequency drift of a metal trace can be adjusted; by adjusting length of a radiating section, band width of a high-frequency band can be adjusted; and by using an in-mode decoration metal processing and an LDS processing, the problem of existence of a color difference at a gap in a conventional metal ring solution can be effectively avoided.

The above-described are only embodiments of the present disclosure. It shall be noted that those skilled in the art may make improvements without departing from the concept of the present disclosure. All these improvements fall into the protection scope of the present disclosure.

What is claimed is:

1. A antenna system, applied to a mobile terminal, the mobile terminal comprising a metal bezel, a plastic back shell adjacent to the metal bezel and a main board accommodated in the plastic back shell; wherein, one end of the main board is provided with a clearance region;

the antenna system comprises a metal trace disposed on a surface of the plastic back shell and corresponding to the clearance region;

the metal trace comprises:

a feed section, a radiating section, in bent extension from one end, closer to the metal bezel, of the feed section, and a first loop unit and a second loop unit, in bent extension from the other end of the feed section to both sides of the feed section respectively;

the metal trace is disposed as opposite to and separated from the metal bezel;

the main board is provided with one feed point connected to both the feed section and the metal bezel, two ground points respectively connected to an end, away from the feed section, of the first loop unit and an end, away from the feed section, of the second loop unit, and a tuning switch connected to the metal bezel.

2. The antenna system according to claim 1, wherein operation frequency bands of the antenna system are 700-960 MHzs and 1710-2690 MHzs.

3. The antenna system according to claim 2, wherein the width of the clearance region is 1.87 mm.

4. The antenna system according to claim 1, wherein the width of the clearance region is 1.87 mm.

5. The antenna system according to claim 1, wherein the metal trace is disposed at the plastic back shell through an LDS processing.

6. The antenna system according to claim 1, wherein the first loop unit comprises a first part extending from the feed section to a direction away from the second loop unit, a second part extending from an end, away from the feed section, of the first part to a direction towards the metal bezel, and a third part extending from an end, away from the first part, of the second part to a direction approaching the second loop unit;

wherein an end, away from the second part, of the third part is connected to the ground point.

7. The antenna system according to claim 6, wherein the second loop unit comprises a fourth part extending from the feed section to a direction away from the first loop unit, a fifth part vertically extending from an end, away from the feed section, of the fourth part to a direction towards the metal bezel, and a sixth part extending from an end, away from the fourth part, of the fifth part to a direction approaching the first loop unit;

wherein an end, away from the fifth part, of the sixth part is connected to the ground point.

8. A mobile terminal, comprising an antenna system; wherein the mobile terminal comprises a metal bezel, a plastic back shell adjacent to the metal bezel and a main board accommodated in the plastic back shell;

one end of the main board is provided with a clearance region;

the antenna system comprises a metal trace disposed on a surface of the plastic back shell and corresponding to the clearance region;

the metal trace comprises:

a feed section, a radiating section, in bent extension from one end, closer to the metal bezel, of the feed section, and a first loop unit and a second loop unit, in bent extension from the other end of the feed section to both sides of the feed section respectively;

the metal trace is disposed as opposite to and separated from the metal bezel;

the main board is provided with one feed point connected to both the feed section and the metal bezel, two ground points respectively connected to an end, away from the feed section, of the first loop unit and an end, away from the feed section, of the second loop unit, and a tuning switch connected to the metal bezel.

9. The mobile terminal according to claim 8, wherein operation frequency bands of the antenna system are 700-960 MHzs and 1710-2690 MHzs.

10. The mobile terminal according to claim 9, wherein the width of the clearance region is 1.87 mm.

11. The mobile terminal according to claim 8, wherein the width of the clearance region is 1.87 mm.

12. The mobile terminal according to claim 8, wherein the metal trace is disposed at the plastic back shell through an LDS processing.

13. The mobile terminal according to claim 8, wherein the first loop unit comprises a first part extending from the feed section to a direction away from the second loop unit, a second part extending from an end, away from the feed section, of the first part to a direction towards the metal bezel, and a third part extending from an end, away from the first part, of the second part to a direction approaching the second loop unit;

wherein an end, away from the second part, of the third part is connected to the ground point.

14. The mobile terminal according to claim 8, wherein the second loop unit comprises a fourth part extending from the feed section to a direction away from the first loop unit, a fifth part vertically extending from an end, away from the feed section, of the fourth part to a direction towards the metal bezel, and a sixth part extending from an end, away from the fourth part, of the fifth part to a direction approaching the first loop unit;

wherein an end, away from the fifth part, of the sixth part is connected to the ground point.

* * * * *